United States Patent [19]

Del Paggio et al.

[11] 3,988,179

[45] Oct. 26, 1976

[54] METHOD AND APPARATUS FOR INDUCTIVELY HEATING ELONGATED WORKPIECES

[75] Inventors: Anthony F. Del Paggio; Norbert R. Balzer, both of Parma, Ohio

[73] Assignee: Park-Ohio Industries, Inc., Cleveland, Ohio

[22] Filed: Jan. 9, 1975

[21] Appl. No.: 539,926

[52] U.S. Cl. ..... 148/153; 72/69; 219/10.41; 219/10.57; 219/10.69; 219/10.79; 266/129; 219/159

[51] Int. Cl.[2] ..... C21D 1/66; C21D 1/42; H05B 5/00

[58] Field of Search ..... 219/10.41, 10.43, 10.57, 219/10.67, 10.69, 10.73, 10.75, 10.77, 10.79, 7.5, 159; 148/12.4, 143, 144, 150, 153, 154, 155; 266/4 A, 4 EI, 5 EI; 72/69

[56] References Cited

UNITED STATES PATENTS

| | | | |
|---|---|---|---|
| 2,737,563 | 3/1956 | Abel | 219/10.79 X |
| 2,743,345 | 4/1956 | Seulen et al. | 219/10.79 X |
| 2,787,566 | 4/1957 | Seulen et al. | 266/4 EI X |
| 3,240,480 | 3/1966 | Cary | 266/4 EI |
| 3,383,100 | 5/1968 | Balzer et al. | 266/4 A |
| 3,494,604 | 2/1970 | Reinke et al. | 266/4 EI |
| 3,648,995 | 3/1972 | Seyfried et al. | 266/4 EI |
| 3,705,715 | 12/1972 | Sheetz | 266/4 EI X |
| 3,737,610 | 6/1973 | Armstrong | 219/10.57 X |

*Primary Examiner*—Laramie E. Askin
*Attorney, Agent, or Firm*—Meyer, Tilberry & Body

[57] ABSTRACT

There is provided a method and apparatus for inductively heating elongated workpieces having a central axis and mounted in workpiece receiving stations of an indexable turret. A single shot inductor located within the path generally followed by the indexing workpieces is used to heat the workpieces. One of the turret stations, when empty, is indexed past the single shot inductor in a first direction and is loaded with a workpiece. Thereafter, the loaded station is indexed in a second direction into the heating position with the workpiece located in the single shot inductor. Thereafter, the workpiece is indexed from the single shot inductor for subsequent processing on the turret.

26 Claims, 14 Drawing Figures

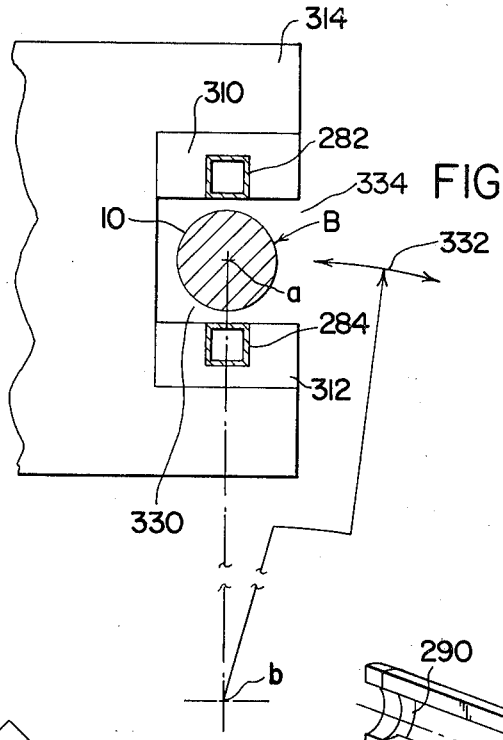
FIG. 5
FIG. 6
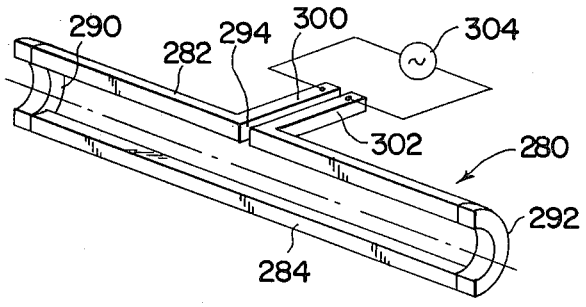
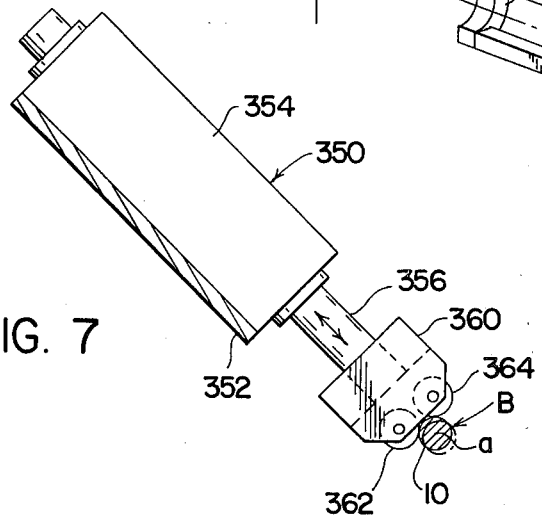
FIG. 7
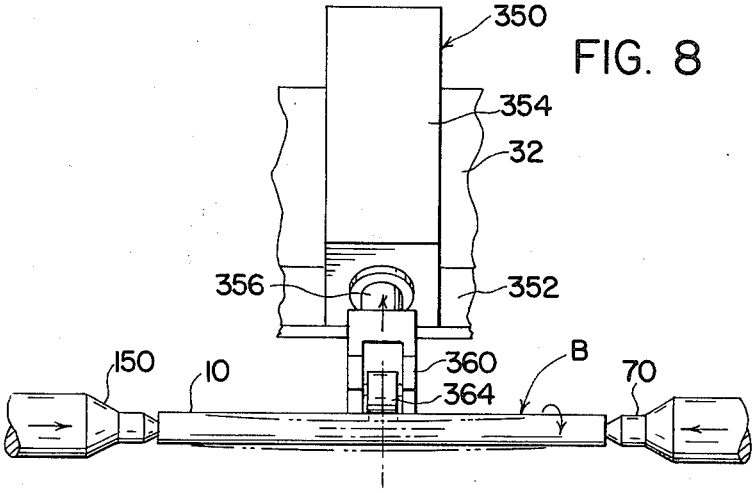
FIG. 8

METHOD AND APPARATUS FOR INDUCTIVELY HEATING ELONGATED WORKPIECES

This invention relates to the art of induction heating with a single shot inductor and more particularly to a method and apparatus for inductively heating elongated workpieces using a single shot inductor.

The invention is particularly applicable for inductively heating elongated axle shafts for subsequent quench hardening and it will be described with particular reference thereto; however, it should be appreciated that the invention has broader applications and may be used for inductively heating various elongated workpieces for a variety of processing operations, such as hardening, tempering, straightening and the like.

It has become somewhat common practice to heat an axle shaft and other elongated workpieces by rotating the shaft in a single shot inductor including two generally parallel conductors with cross-over conductors at each end. These conductors form a loop which is broken at a given position and connected to a source of high frequency alternating current. As the workpiece is rotated, the total length of the workpiece is heated by the inductor. With this type of equipment, there has been difficulty in processing a plurality of workpieces in succession. One of the more common systems now being used is to mount the workpiece on an indexable turret. A workpiece is loaded into a workpiece supporting station in a first location. The turret is then indexed to a heating position. At the heating position, the single shot inductor is shifted down over the workpiece, which is then rotated while the inductor is energized by an alternating current source. If the workpiece is to be hardened, it is then transferred into a quench hardening substance, such as liquid, for quench hardening the previously heated surface of the workpiece. Thereafter, the workpiece or axle shaft is removed from the turret. In this manner, a plurality of stations on the turret can process a series of shafts successively. This system has two distinct disadvantages. First, the inductor must be movably mounted and synchronized with the rotation of the turret. As the workpiece is shifted into the heating position, the inductor is then moved into the heating position around the shaft. The required flexible connections to the movable inductor complicate the design of this system. Also, it is difficult for an operator to view the heating operation when the workpiece is surrounded by the inductor.

The present invention is directed toward a method and apparatus which overcomes the disadvantages of prior systems used in inductively heating a succession of elongated workpieces with a single shot inductor. In accordance with the present invention, there is provided a device for inductively heating an elongated workpiece having a central axis. This device comprises a fixed elongated single shot inductor which has an open side defined by the two parallel conductors of the inductor. In addition, a conveyor means is provided for moving the workpiece toward and away from the inductor in an arcuate path extending into the open side of the inductor and in a direction transverse to the central axis of the workpiece. The workpiece is moved between a first position with the workpiece magnetically coupled with the inductor and surrounded thereby and a second position spaced substantially from the inductor. The conveyor means includes two axially spaced centers defining an axis generally parallel to the central axis of the workpiece and rotatably supporting the workpiece therebetween and means for rotating the workpiece between the center means. In this arrangement, in accordance with the invention, the workpiece can be shifted in an arcuate path into the heating position and then shifted from the heating position in the same arcuate path without losing control over the workpiece during the heating and moving operations.

In accordance with another aspect of the present invention, there is provided a device as defined above wherein the workpiece is located on a turret having at least two workpiece supporting stations and rotatable about a turret axis generally parallel to the parallel conductors of the single shot inductor. Each station on the turret includes means for mounting the workpiece on the support axis which is generally parallel to the turret axis and is radially spaced from the turret axis a distance generally equalling the spacing between the turret axis and the heating chamber of the single shot inductor. There is further provided means for rotating the turrent in a first direction with an empty station passing the inductor and means for rotating the turret in a second direction opposite to the first direction. In this manner, a loaded station brings a workpiece into the heating chamber of the inductor. An unloaded station of the turret is moved past the single shot inductor in one direction. After passing the inductor in this one direction, the unloaded station is loaded with a workpiece and is moved, or indexed, in an opposite direction into the heating chamber of the single shot inductor for heating. This arrangement allows the use of a fixed single shot inductor which is not moved into and out of the path of a moving workpiece.

In accordance with still a further object of the present invention there is provided means for retracting the centering means of the several workpiece supporting stations on the turret as the station is moved past the inductor. Consequently, the supporting elements on the workpiece supporting station can extend inwardly toward each other a distance less than the length of the single shot inductor and still be moved past the inductor by the provision of the shifting means.

In accordance with the invention there is also provided a method of utilizing the apparatus as defined above.

The primary object of the present invention is the provision of a method and apparatus for inductively heating elongated workpieces by using an indexable turret and a single shot inductor, which method and apparatus allow rapid processing of the workpieces without loss of control thereover and which are relatively inexpensive to produce and use.

Yet another object of the present invention is the provision of a method and apparatus for inductively heating elongated workpieces by using an indexable turret and a single shot inductor, which method and apparatus use a fixed inductor and the workpieces remain on the turret during the heating thereof.

Another object of the present invention is the provision of a method and apparatus for inductively heating elongated workpieces by using an indexable turret and a single shot inductor, which method and apparatus use a fixed inductor allowing the heating operation to be viewed by an operator.

Still a further object of the present invention is the provision of a method and apparatus as defined above, which method and apparatus maintain control over the workpieces during several processing operations performed on the workpieces.

Another object of the present invention is the provision of a method and apparatus, as defined above, which method and apparatus require a relatively short time between the heating and quenching, when the workpieces are to be quench hardened.

Still a further object of the present invention is the provision of a method and apparatus, as defined above, wherein the delay between the heating and quenching operation allows sufficient time for an auxiliary operation, such as a straightening operation.

These and other objects and advantages will become apparent from the following description taken together with the accompanying drawings, in which:

FIG. 5 is an enlarged cross-sectional view taken generally along line 5—5 of FIG. 2;

FIG. 6 is a pictorial view showing the single shot inductor contemplated in the preferred embodiment of the present invention;

FIG. 7 is an enlarged cross-sectional view taken generally along line 7—7 of FIG. 2;

FIG. 8 is a pictorial operational view taken generally along line 8—8 of FIG. 1;

Figure 1:
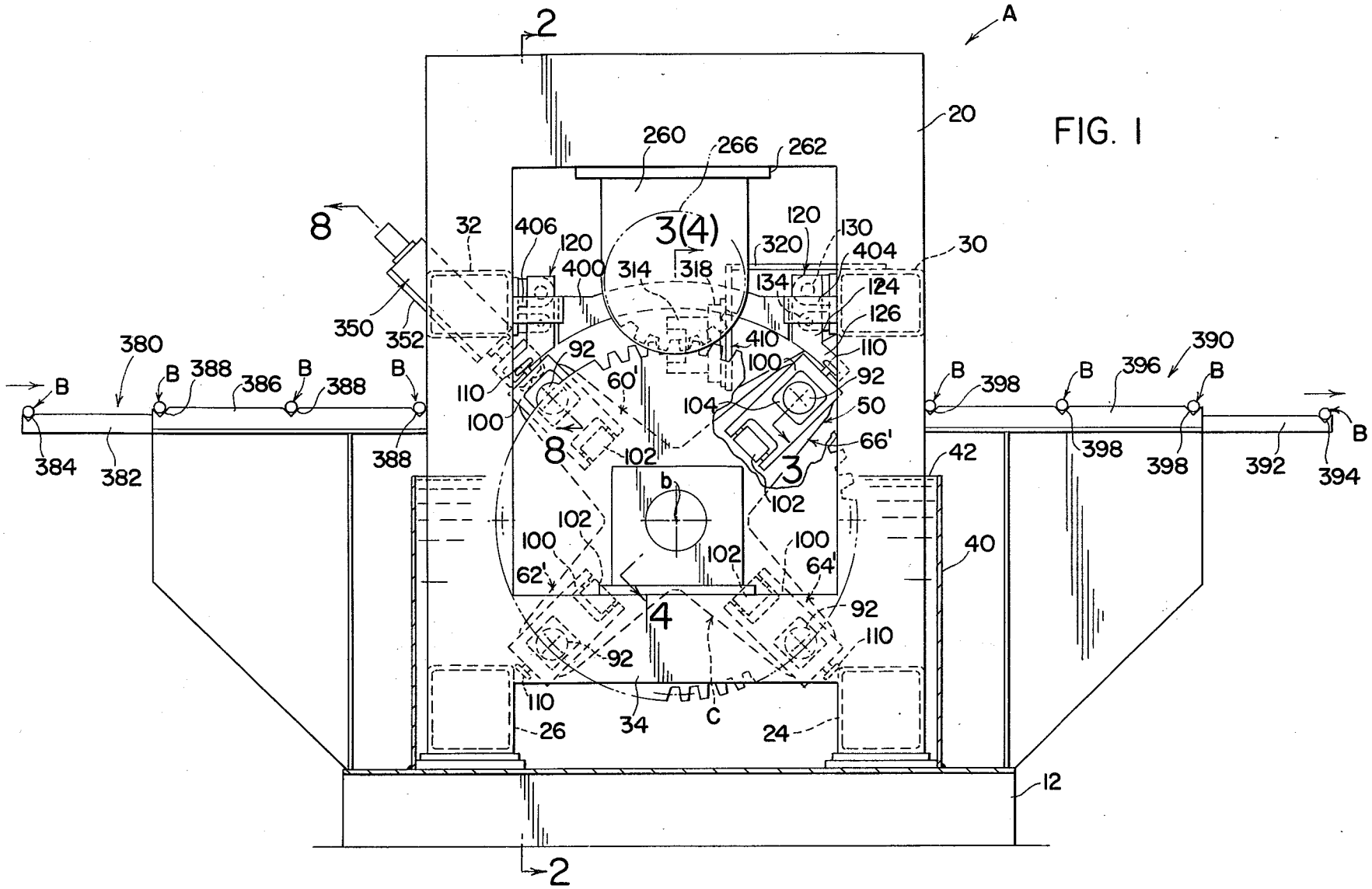
FIG. 1 is a side elevational view showing the preferred embodiment of the present invention.
Figure 2:
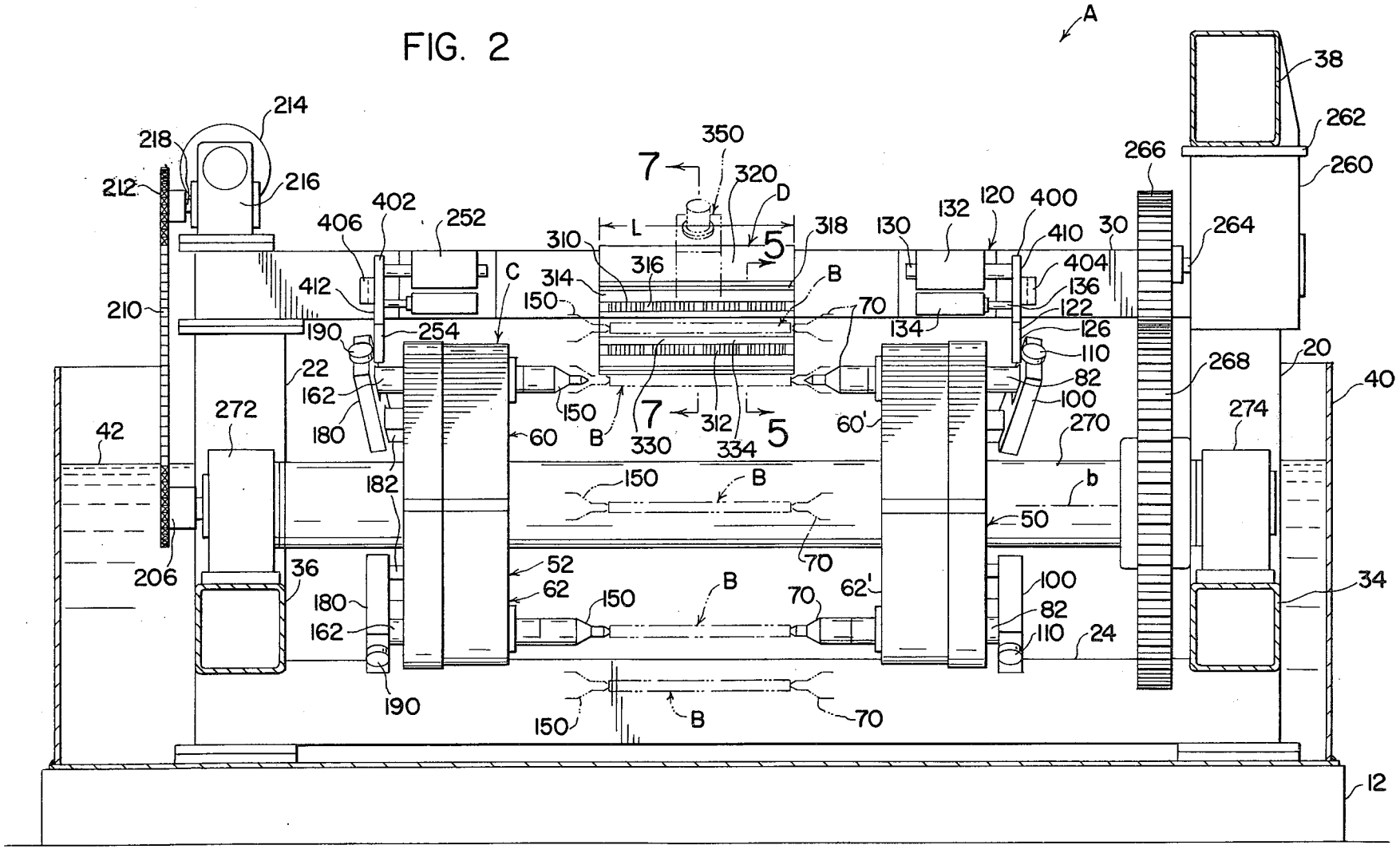
FIG. 2 is a cross-sectional view taken generally along line 2—2 of FIG. 1.
Figure 3:
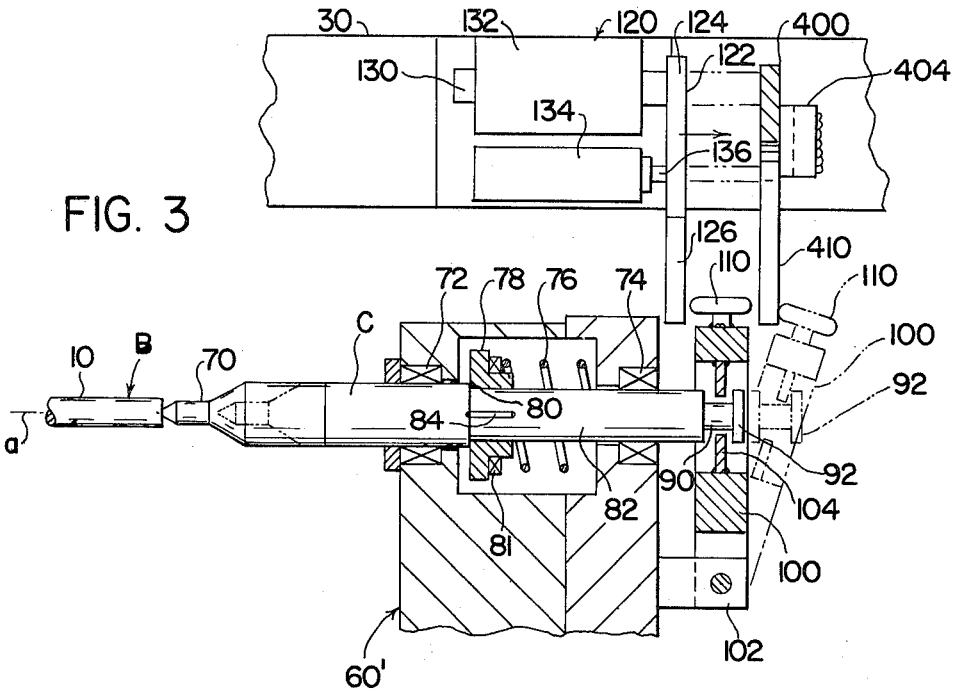
FIG. 3 is an enlarged cross-sectional view taken generally along line 3—3 of FIG. 1.
Figure 4:
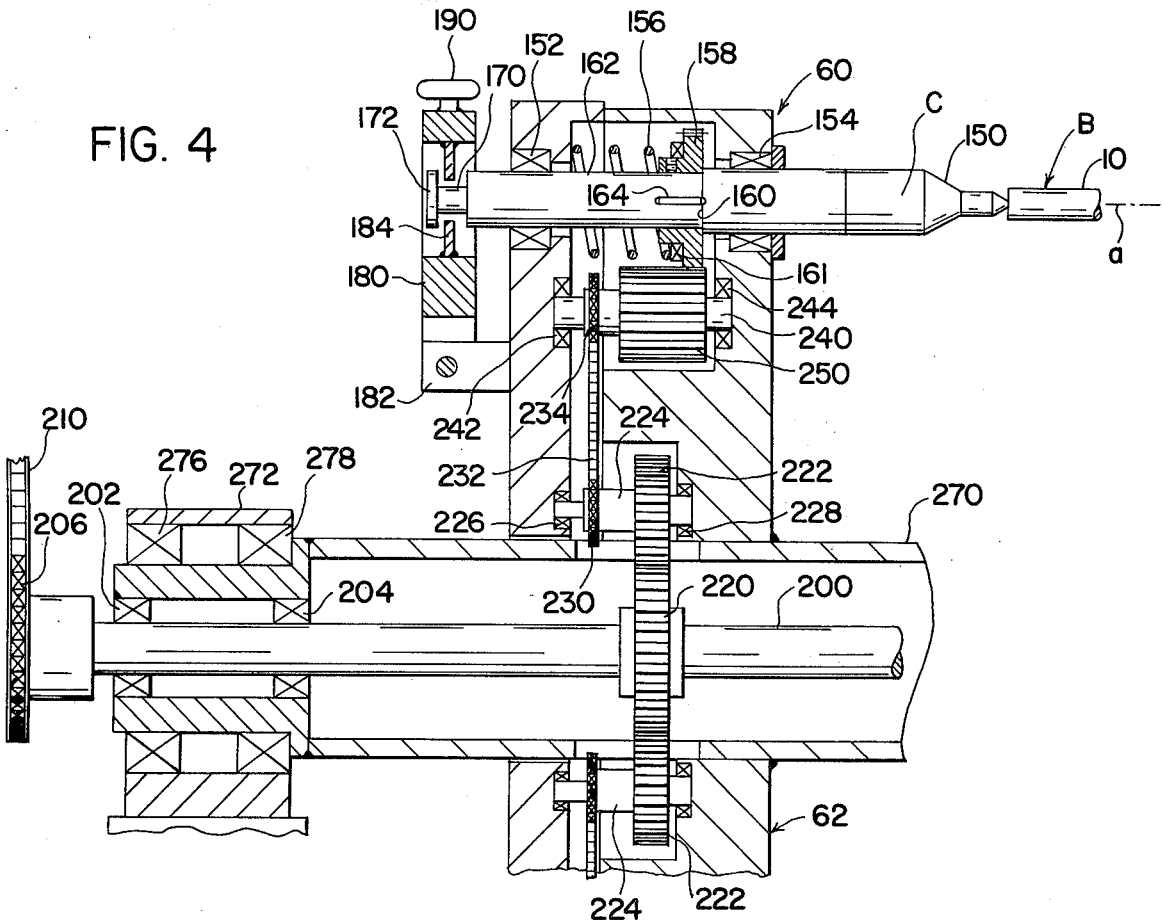
FIG. 4 is an enlarged cross-sectional view taken generally along line 4—4 of FIG. 1.

Referring to the drawings wherein the showings are for the purpose of illustrating a preferred embodiment of the invention only and not for the purpose of limiting same, FIGS. 1 and 2 show an apparatus A for heating elongated workpieces B carried on turret C. The heating operation is accomplished by a single shot inductor assembly D which is fully visible from the front of apparatus A, as shown in FIG. 2. Each of the workpieces has a generally longitudinal central axis a and an outer concentric, cylindrical surface 10 which is to be heated during the heating operation. FIGS. 3, 4 and 8 illustrate better the type of workpieces being heated, in accordance with the illustrated embodiment of the invention. These workpieces may be axle shafts and in some instances may include a flange at one end. Of course other elongated workpieces could be heated. In accordance with the preferred embodiment of the invention, the workpieces to be heated are subsequently quench hardened. The invention has broader applications and it could be used for inductively heating the workpieces B for a variety of processing purposes.

In accordance with the illustrated embodiment of the invention, apparatus A is supported by a plurality of structural elements including a base 12, spaced upright frames 20, 22, lower longitudinal beams 24, 26, upper longitudinal beams 30, 32, lower transverse beams 34, 36 and an upper transverse beam 38. These beams cooperate to provide a support for the illustrated mechanisms. Surrounding the lower beams there is provided a tank 40 for holding a quenching liquid to a level 42. In the preferred embodiment, after a workpiece is inductively heated, the cylindrical surface 10 is quench hardened to provide an outer hardened surface.

In accordance with the preferred embodiment of the invention, indexable turret C is indexed about a central axix b and includes two spaced spiders 50, 52 having radially outwardly extending arms. Spider 50 includes arms 60′, 62′, 64′ and 66′. Spider 52 includes arms 60, 62, 64, and 66. These arms are paired to define workpiece supporting stations for workpieces B in a manner to be described later. The stations are labeled I, II, III and IV in FIGS. 9A–9E. Thus, two of the arms, such as arms 60, 60′ coact to define a single workpiece supporting station I. The other workpiece supporting stations are defined by the arms in accordance with their respective pairings. In accordance with this embodiment of the invention, only four workpiece receiving stations are provided on turret C; however, various numbers of workpiece receiving stations could be provided on the turret.

Each of the workpiece supporting stations, such as station I including arms 60, 60′, is substantially identical; therefore, only station I will be described in detail. This description will apply equally to the other stations formed by arms 62, 62′, 64, 64′, and 66, 66′. Referring more particularly to FIG. 3, arm 60′ includes a reciprocal center 70 reciprocated within axially spaced bearings 72, 74 against the action of spring 76 coacting with collar 78 to force center 70 into the extended, solid line position of FIG. 3. Collar 78 abuts shoulder 80 and spring 76 rides against thrust bearing 81 surrounding a reduced shaft portion 82 of center 70. Collar 78 is held onto this reduced shaft portion by a key 84. To retract center 70 into the phantom line position shown in FIG. 3, there is provided at the rear end of shaft portion 82 a circumferentially extending recess 90 and an end button 92. Actuator arm 100 is pivotally mounted upon a trunnion 102 and includes an apertured pulling plate 104 which surrounds recess 90 and coacts with button 92 to retract center 70 upon pivoting of actuator arm 100 into the phatom line position shown in FIG. 3. The actuator arm includes a cam follower, or actuating knob 110 which is engaged to cause pivoting of arm 100 in a manner to be described later.

Operators 120 at two separate locations, as shown in FIG. 1, are used to pivot arm 100 for retracting center 70. One of these operators is located on longitudinal beam 30 and the other is located on longitudinal beam 32. Since these two operators are substantially the same and differ only in that they are at different index locations of turret C, only one operator 120 will be described. This description will apply equally to the other operator for retracting center 70. Each of these operators includes a pusher plate 122, best shown in FIG. 3. Plate 122 includes an upright portion 124 and a generally arcuate lower lip 126 having a profile best shown in FIG. 1. This lip engages knob 110 for pivoting arm 100. To accomplish this action, each operator 120 includes support rod 130 reciprocally mounted within journal 132 for guiding movement of plate 122. A cylinder 134 includes a push rod 136 which forces plate 122 between the two positions shown in FIG. 3. In the outer position, center 70 is retracted into the phantom line position. The arcuate shape of lip 126 is for the purpose of providing clearance of the elements, except knobs 110, on the turret as the turret is indexed.

Referring now to the opposite end of the workpiece supporting station I defined by arms 60, 60′, a live center 150, shown in FIG. 4, is reciporcally mounted within bearings 152, 154 and biased by spring 156 to the solid line position shown in FIG. 4. Spring 156 acts against gear 158, which is in the form of a gear that bears against shoulder 160. Spring 156 engages thrust bearing 161 to allow rotation of collar or gear 158 with respect to the biasing spring. Gear 158 is held on reduced shaft portion 162 of center 150 by a key 164. The rear end of shaft portion 162 includes a circumferentially extending recess 170, similar to recess 90 of center 70. The rear end of shaft portion 162 includes an end button 172 which coacts with a pivotally mounted actuating arm 180 pivoted about a trunnion 182. The operator arm includes an apertured pulling plate 184 having an aperture surrounding recess 170. Of course buttons 92, 172 can be threadably mounted onto the centers for assembly purposes. The cam follower or actuating knob 190 corresponds to knob 110 of center 70, as shown in FIG. 3.

Centers 70, 150 of each workpiece supporting station are in alignment and define a supporting axis generally corresponding to the axis of a workpiece B held between the centers. Of course each workpiece includes a center countersink to allow concentric mounting between centers 70, 150. When a flange is provided on the workpiece, an appropriate flange mounting arrangement can be provided for the flanged end of the workpiece, in accordance with normal practice. By retracting the centers 70, 150, a workpiece may be loaded or unloaded into a given supporting station, of which four are shown in the illustrated embodiment of the present invention.

Since the workpiece is to be rotated during heating, as will be explained later, an appropriate arrangement should be provided for rotating the workpieces selectively. Various structures could be used for this purpose. Separate motors could be provided for each of the stations I, II, III, and IV. In this manner, a selected one of the workpieces could be rotated. In addition, a common rotating means could be provided for all of the live centers 150. The embodiment of the invention, shown in FIG. 4, illustrates the latter type of arrangement for rotating the workpieces about their central axes a. In accordance with this illustrated embodiment, a drive shaft 200 is supported at spaced bearings 202, 204. One set of bearings is illustrated in FIG. 4 and includes bearings 202, 204. A sprocket 206 is secured at one end of shaft 200 and is connected by a chain 210 with a sprocket 212 shown in FIG. 2. This sprocket is driven by a motor 214 through a gear reducer 216 having an output shaft 218. As motor 214 is energized, chain 210 rotates sprocket 206 for rotation of shaft 200. A gear 220 is secured onto shaft 200 and is drivingly connected with a drive gear 222 for each of the radially extending arms 60, 62, 64, and 68. Only two of these gears are illustrated in FIG. 4. Gears 222 for each arm drive shaft 224 which is journalled in bearings 226, 228. Shaft 224 includes a sprocket 230 which drives chain 232 connected at its radially outward end with a sprocket 234. This sprocket in turn drives shaft 240 journalled in bearings 242, 244. A gear 250 having an axial length sufficient to allow travel of gear 158 during retraction of center 150 drives the gear 158 to rotate center 150. This provides a drive for the various centers 150 when motor 214 is rotated and the indexed position of turret C does not affect the driving relationship with the centers.

Centers 70, 150 define a supporting axis c which corresponds to the central axis a of a loaded workpiece within a workpiece supporting station. To retract centers 150, there are provided two operators 252, which are essentially the same as operators 120 for the centers 70. Lower lip 254 of operators 252 corresponds essentially to lower lip 126 of operators 120. Operators 120, 252 operate as a set, as shown in FIG. 2. A set of operators can be provided at any position where the centers are to be retracted, such as for loading or unloading. In accordance with the illustrated embodiment, only two positions are used for loading and unloading. Consequently, sets of operators 120, 252 are provided in only two indexed positions of turret C. When a workpiece supporting station is adjacent these indexed positions, operation of operators 120, 252 retracts the centers for loading or unloading a workpiece.

Referring now more particulary to the indexable turret C, which rotates about a turret axis *b*, an appropriate indexed drive 260 is provided. This drive is mounted upon plate 262 secured to the upper transverse beam 38, as best shown in FIG. 2. An output shaft 264 drives pinion gear 266, which is meshed with gear 268 drivingly secured to a tube or shaft 270 extending between journal blocks 272, 274. The axis of turret C is parallel to the workpiece supporting axis so that rotation of the turret will cause workpieces B to move in a circular path around the tube or shaft 270 and more particularly about its inner turret axis *b*. Journal blocks 272, 274 could have various structural features; however, in accordance with the illustrated embodiment, these journal blocks include two spaced bearings 276, 278, as shown in FIG. 4. By energizing the indexing drive mechanism 260, turret C can be indexed clockwise or counterclockwise into various positions identified as positions 1–8 in FIGS. 9B–9E. The sequence of indexing will be explained later to provide the proper sequence for loading, heating, straightening, quenching and unloading.

In accordance with the present invention, apparatus A includes inductor assembly D having an axial length 1, best shown in FIG. 2. This assembly includes a somewhat standard single shot inductor 280, best shown in FIG. 6. This single shot inductor comprises a loop having two generally parallel conductors 282, 284 and axially spaced cross-over conductors 290. 292. The loop is broken at a position, such as position 294, to provide input leads 300, 302 which are connected across the output of an appropriate alternating current power supply, schematically illustrated as generator 304. In accordance with normal practice, U-shaped iron laminations 310, 312 are provided around the parallel conductors 282, 284 for concentrating the flux within a workpiece B as the workpiece is indexed into the position shown in FIG. 5 and is rotated there by the drive mechanism previously described. Inductor 280 and its iron laminations 310, 312 are supported on a base 314 and secured by standard holding lugs 316, best shown in FIG. 2. A support plate 318 and a support bracket 320 fixedly secure the inductor assembly D so that a central heating chamber 330 defined within assembly D faces horizontally and is positioned parallel to the axes of workpieces B as they are rotated into the heating position along a path 332 defined by the turret axis *b* and the spacing of centers 70, 150 from this turret axis. The heating chamber has a length corresponding to the length of the workpiece to be heated, which is generally length 1 shown in FIG. 2. The elongated heating chamber 330 has an open side 334 facing horizontally for viewing by an operator, as shown in FIGS. 2 and 5. The workpiece can be moved along path 332 into the heating position shown in FIG. 5. In this manner, an operator viewing the heating apparatus as illustrated in FIG. 2 can view the rotating workpiece and its heating progress while the heating operation takes place. In the past, single shot inductors have been moved over the workpiece in an apparatus of the type to which the present invention is directed so that actual viewing of the heating operation was somewhat difficult. By providing a fixed single shot inductor with its opening facing horizontally, the inductor need not be moved. Operation of the apparatus to allow a fixed location or position for the inductor will be described later.

In accordance with the present invention, after the workpiece has been heated by the inductor assembly D and before it has been quenched into the quenching liquid, a straightening operation is provided. This straightening operation is performed by a straightener 350 supported on beam 32, as shown in FIGS. 1, 7 and 8. Mounting plate 352 supports the straightener device which is, in turn, supported or secured to beam 32. A cylinder 354 actuates a rod 356 having a head 360 with two pressure rollers 362, 364. These pressure rollers engage a heated workpiece B intermediate the centers 70, 150, as shown in FIG. 8. As the workpiece is rotated, head 360 is driven inward to flex the workpiece B beyond its normal axis. Then head 360 is slowly withdrawn to allow straightening of the heated workpiece. This is a known straightening operation and is used as an auxiliary attachment to the apparatus constructed in accordance with the preferred embodiment of the present invention.

To load workpiece B onto turret C between centers 70, 150, there is provided a loading conveyor 380 of the walking beam type, as shown in FIG. 1. This type of conveyor is well known and includes two walking beams 382 with a plurality of spaced V-shaped slots 384. A pair of stationary plates 386 include a plurality of V-shaped slots 388. Only one of the beams 382 and plate 386 is shown. By moving the beams 382 upward, the workpieces are located in slots 384. Beams 382 are then moved forward to the next group of slots on plates 386. Then beams 382 are lowered and moved backward. This conveying operation deposits a workpiece between centers 70, 150 at the loading position of apparatus A. Of course, other similar loading conveyors could be used for this purpose. In accordance with the illustrated embodiment, the unloading conveyor 390 also includes a walking beam concept, as shown in FIG. 1. In this instance, walking beam 392 have V-shaped slots 394. Stationary plates 396 have V-shaped slots 398. The operation of the unloading conveyor is similar to the operation of the loading conveyor except the workpieces are progressed away from apparatus A instead of being progressed toward the apparatus. In the loading position, centers 70, 150 are opened for a given workpiece supporting station and deposited onto the beams 392 for withdrawal from apparatus A.

As has been previously mentioned, such workpiece receiving station is defined by two spaced arms on turret C. These arms, in accordance with the invention, pass by inductor assembly D when an unloaded station is to be loaded. To allow this, without interference, centers 70, 150 must be retracted into the position shown in FIG. 1 wherein the spacing between the centers is greater than the length 1 of inductor assembly D. Since the operators or actuating devices 120, 252 retract the centers 70, 150, respectively, at a given location prior to the inductor assembly D, there is provided two spaced camming plates 400, 402. Plates 400 are shown in FIGS. 1, 2 and 3. The corresponding similar plate 402 is shown only in FIG. 2 and is substantially the same as plate 400. These plates are connected by circumferentially spaced offset brackets 404, 406, respectively. In this manner, the upright portions 124 of operators 120, 252 can be shifted so that their outer surfaces align with the outer surfaces of plates 400, 402 as shown in FIG. 2. The relationship of the upright portions 124 and 126 is shown in FIG. 1 so that they, in essence, form an extension of the camming plate 400. The outer surface 410 of the camming plate aligns with the outer surfaces of these upright portions and lips to allow the outwardly cammed knobs 110, 190 to pass from the lip portions 126, 254 onto the outer surfaces 410 and 412 of the camming plates 400, 402, respectively. In this manner, when the centers 70, 150 are cammed outwardly as shown in FIGS. 2 and 3, indexing of turret C in the counterclockwise direction, shown in FIG. 1, brings the knobs 110, 190 onto the surfaces 410, 412 of camming plates 400, 402. Further indexing of turret C in a counterclockwise direction, as shown in FIG. 1, is accomplished without the knobs 110, 190 moving inwardly. They are held outwardly by the surfaces 410, 412 of camming plates 400, 402. Thus, the centers 70, 150 are held in the retracted position as the unloaded station is indexed past the inductor assembely D. After passing the inductor assembly and riding past plates 400, 402, the knobs 110, 190 are held by the next set of operators 120, 252. This is at the loading position. Consequently, the centers are held open until a workpiece is loaded into the position between centers 70, 150. Thereafter, the operators 120, 252 at the left end of camming plates 400, 402, as viewed in FIG. 1, i.e. at the loading position, are retracted into the solid line position shown in FIG. 3. This allows the centers 70, 150 to move inwardly into engagement with the workpiece B loaded onto turret C. Thus, the operators 120, 252 open the centers and allow the unloaded station of turret C to pass by the inductor assembly D. Thereafter, a workpiece is loaded between the centers and the next set of operators, 120, 252 is retracted to load the workpiece therein.

Figure 9:
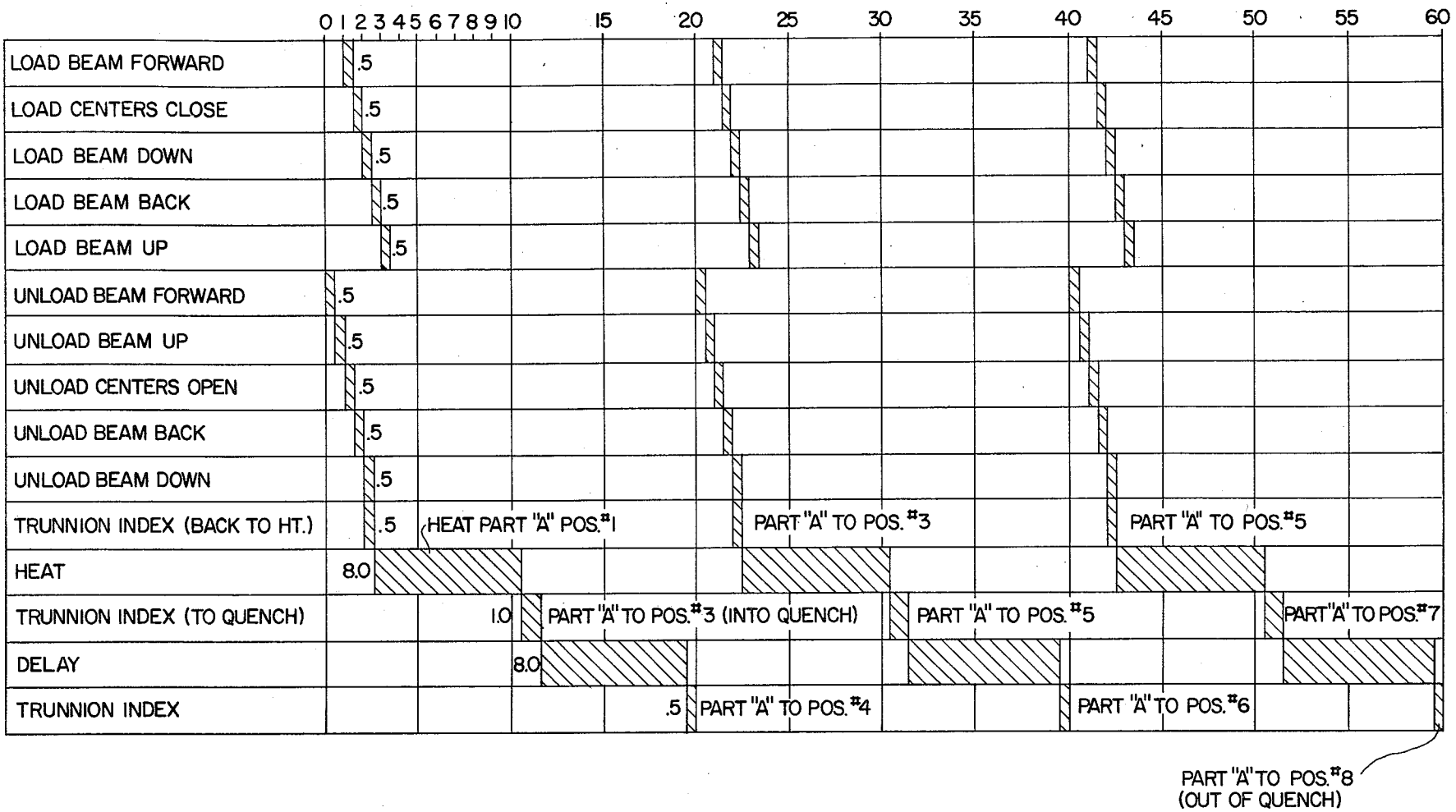
FIG. 9 is a chart showing the timing sequence of the preferred embodiment of the present invention; and, FIGS. 9A–9E are schematic views illustrating the operating cycle of the preferred embodiment of the present invention.
Figure 9A:
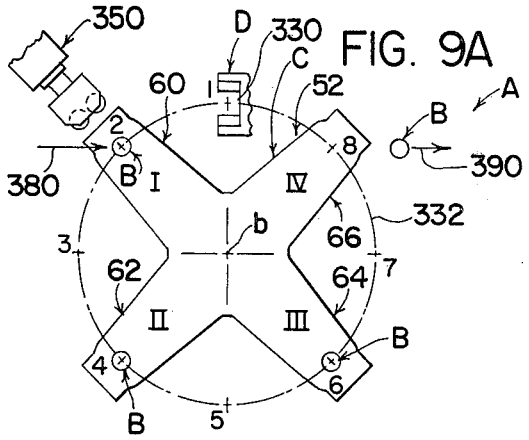
Figure 9B:
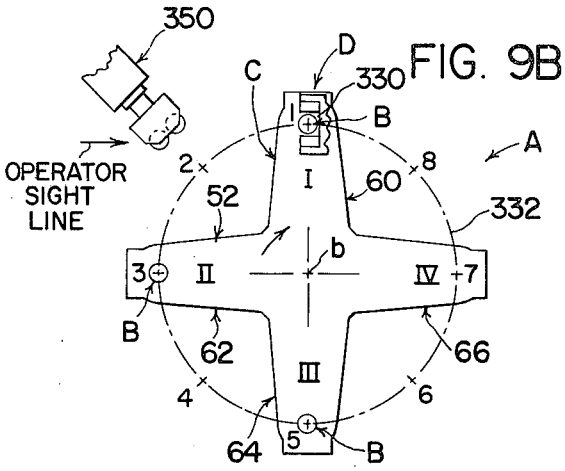
Figure 9C:
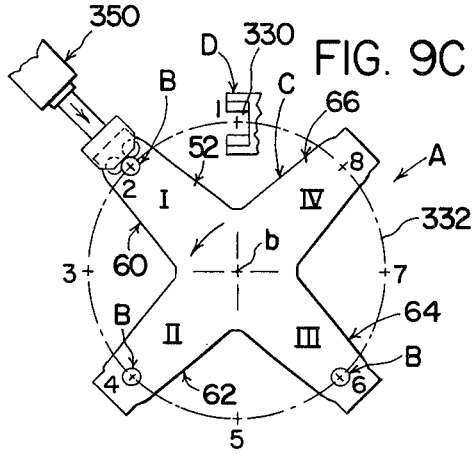
Figure 9D:
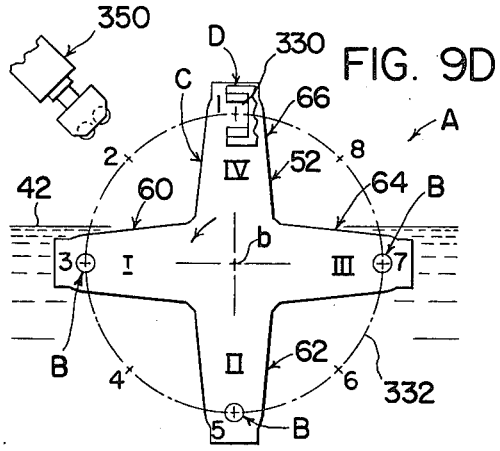
Figure 9E:
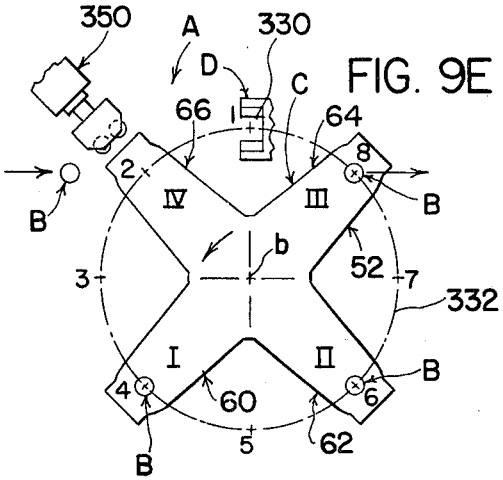

Operation of the preferred embodiment of the invention is illustrated in FIGS. 9A and 9E. The separate workpiece supporting stations are labeled I, II, III and IV. Of course, turret C could include various numbers of workpiece receiving stations. There are eight indexed positions labeled 1–8 for turret C. The number of positions is twice the number of supporting stations. Referring now to FIG. 9A, a workpiece is loaded onto station I (position 2) and a workpiece is removed from station IV. Workpieces on stations II and III are in the quenching liquid at positions 4 and 6, respectively, after being heated at position 1 and straightened at position 2. Referring now to FIG. 9B, the workpiece loaded between centers 70, 150 of station I is now rotated into the heating chamber 330 (position 1) of inductor assembly D by clockwise rotation of turret C. At this position, the workpiece B is rotated and the inductor of assembly D is energized. After a preselected heating cycle, which can be viewed by the operator from the front of the machine, turret C is indexed in a counterclockwise direction as shown in FIG. 9C to position 2 where the straightening head 350 is located.

At this position, the heated workpiece is straightened before entering the quenching liquid. The previously processed workpieces on stations II and III are still within the quenching liquid. After the straightening operation at position 2, turret C is indexed with the unloaded workpiece supporting station IV passing inductor assembly D. To accomplish this, the opeators 120, 252 must retract the centers as explained above. This indexing, as shown in FIG. 9D, brings the previously heated and straightened workpiece into the quenching liquid below the level 42 and at position 3. The quenching operation then takes place. A workpiece at station I is not then withdrawn from the liquid until it is to be unloaded. Turret C is then indexed to the position shown in FIG. 9E bringing the empty station IV, which has passed inductor assembly D, into loading position 2. The empty station IV is not aligned with operators 120, 252, so the centers are still open. In addition, in the position shown in FIG. 9E, station III is also aligned with a pair of operators 120, 252 which have been retracted before station III was indexed to position 8. At this position 8 the operators are energized to retract the centers 70, 150 to unload a workpiece from station III. Before this happens, the walking beam has positioned two V-shaped slots underneath the workpiece to allow reception of the workpiece for unloading by conveyor 390, as shown in FIG. 1. At the same time, conveyor 380 loads the workpiece onto station IV at position 2. The operators at position 2 are closed to load a workpiece on station IV. The operators at position 8 remain open after the workpiece has been unloaded to allow passage of station II past the inductor assembly. The devices for opening the centers are located at positions 2 and 8 of indexable turret C. The operators at two positions can open the centers so that plates 400, 402 can hold the centers open as an unloaded station passes inductor assembly D. As shown in FIG. 3, if the centers have been closed in loading position 2, knobs 110, 190 are on the inside of the camming plates 400, 402. Consequently, clockwise movement of the loaded workpiece receiving station does not cause camming of the centers out of engagement with the workpiece. This allows movement in a clockwise direction, as shown in FIG. 9B, to heating position 1. The unloaded position 8 has the centers opened and the camming plates 400, 402 maintain this open relationship until turret C is indexed past inductor assembly D to the loading position 2. Thereafter, the operators 120, 252 are released to allow clockwise movement of a workpiece into the heating position. This process shown in FIGS. 9A–9E is repeated successively to load workpieces at position 2 and unload workpieces at position 8. When the workpiece is indexed from position 2 to heating position 1, the previously heated workpiece is not raised above the level of the quenching fluid. Consequently, the reverse movement into the heating position does not withdraw the workpiece from the quenching tank. For this purpose there are more indexing positions than there are workpiece supporting stations on turret C. Indeed, there are twice as many index positions as there are workpiece supporting stations.

If the normal inward position of centers 70, 150 provides a spacing greater than the length 1 of inductor assembly D, then the camming plates 400, 402 may be omitted. Also, other means may be provided for retracting the centers. For instance, each of the arms 60, 62, 64, 66, 60′, 62′, 64′, and 66′ may have independently operated cylinders or other retracting mechanisms. When such mechanisms are used, they may remain activated when an empty station passes the inductor assembly to omit the need for plates 400, 402. Other modifications to perform the basic concept of the described invention can be made. Any appropriate indexing and sequencing control can be used to operate apparatus A in accordance with the procedure and method set forth in this specification.

Referring now to FIG. 9, this figure is a time sequence indicating the processing of a single workpiece labeled as Part "A" through the various positions shown in FIGS. 9A–9E. The chart of FIG. 9 is in relationship to time for performing the various functions explained in the operation of the preferred embodiment of the present invention.

Having thus described our invention, we claim:

1. A device for inductively heating an elongated workpiece having a central axis, said device comprising a fixed elongated inductor including a loop formed from two generally parallel conductors and two longitudinally spaced generally semi-circular cross-over conductors, said inductor having an open side defined by said two generally parallel conductors; and turret means for moving said workpiece toward and away from said inductor in an arcuate path extending into said open side and in a direction transverse to said central axis of said workpiece, said movement being between a first position with said workpiece in magnetic coupling with said inductor and between said parallel conductors and a second position on said arcuate path and spaced substantially from said inductor, said turret means including two axially spaced center means defining an axis generally parallel to said central axis for rotatably supporting said workpiece therebetween and means for rotating said workpiece between said center means.

2. A device as defined in claim 1 wherein said open side faces generally horizontally.

3. A device for inductively heating elongated workpieces, each having a central axis and a generally cylindrical body to be heated, said device comprising: a fixed induction heating inductor including two generally parallel conductors and two longitudinally spaced, generally semi-circular crossover conductors, said conductors defining a workpiece heating chamber with an open side facing in a given direction; a turret means having at least two workpiece supporting stations and rotatable about a turret axis generally parallel to said parallel conductors, each station including means for rotatably mounting a workpiece on a support axis generally parallel to the turret axis and radially spaced therefrom a distance generally equaling the spacing of said heating chamber from said turret axis; means for rotating said turret means in a first direction with an empty one of said stations passing said inductor and means for rotating said turret means in a second direction opposite to said first direction to bring a loaded one of said stations adjacent said inductor with a workpiece of said loaded station being in said heating chamber, said second direction being toward said open side of said inductor.

4. A device as defined in claim 3 wherein said inductor has a given length and said supporting stations each include axially retractable workpiece supporting elements movable toward each other to a distance less than the length of said inductor and means for axially shifting at least one of said elements of said empty station to provide a spacing between said elements greater than said inductor length when said empty station is rotated past said inductor.

5. A device as defined in claim 4 wherein said one element includes a cam follower and said device includes a cam element adjacent said inductor, said cam element having means defining a cam surface axially spaced from said inductor for engaging said cam follower when said turret means is moved in said first direction, said cam follower coacting with said follower to shift said one element axially from the other of said elements.

6. A device as defined in claim 3 wherein said turret means is rotatable in said first direction from said inductor to an unloading position.

7. A device as defined in claim 6 wherein said unloading position is adjacent said inductor and facing the side of said inductor opposite to said open side.

8. A device as defined in claim 3 including a means spaced from said inductor for forcing a restraint against said cylindrical body of a heated workpiece, said forcing means including means for withdrawing said restraint as said workpiece is being rotated about said support axis of one of said stations.

9. A device as defined in claim 3 wherein said open side faces generally longitudinally.

10. A device for inductively heating elongated workpieces, each having a central axis and a generally cylindrical body, said device comprising: turret means rotatable about a turret axis and having at least two workpiece supporting stations, each of said stations having support means for supporting a workpiece for rotation about a support axis corresponding the central axis, said support axis of said support stations being generally equidistant from said turret axis to define an arcuate path for said workpiece as said turret means is rotated; an induction heating inductor including two generally parallel conductors and two longitudinally spaced generally semi-circular cross-over conductors, said conductors defining a workpiece heating chamber with an open side; means for fixing said inductor with said chamber on said arcuate path and providing clearance for movement of workpieces on one of said support stations into said chamber by rotation of said turret means in a first direction; means for rotating said turret means in a second direction with an empty support station passing said inductor; means on one side of said inductor for loading a workpiece onto one of said support stations; and means on the side of said inductor opposite to said one side for unloading a workpiece from one of said support stations.

11. A device as defined in claim 10 wherein said inductor has a given length and said supporting stations each include axially retractable workpiece supporting elements movable toward each other to a distance less than the length of said inductor and means for axially shifting at least one of said elements of said empty station to provide a spacing between said elements greater than said inductor length when said empty station is rotated past said inductor.

12. A device as defined in claim 11 wherein said one element includes a cam follower and said device includes a cam element adjacent said inductor, said cam element having means defining a cam surface axially spaced from said inductor for engaging said cam follower when said turret means is moved in said second direction, said cam surface coacting with said follower to shift said one element axially from the other of said elements.

13. A device as defined in claim 10 wherein said turret means is rotatable in said second direction from said inductor to an unloading position.

14. A device as defined in claim 10 including a means spaced from said inductor for forcing a restraint against said cylindrical body of a heated workpiece, said forcing means including means for withdrawing said restraint as said workpiece is being rotated about said support axis of one of said stations.

15. A device as defined in claim 10 wherein said open side faces generally longitudinally.

16. A method of inductively heating a succession of elongated workpieces each having central axes and a cylindrical body portion, said method comprising the following steps:

a. providing a fixed heating inductor including two generally parallel conductors and two longitudinally spaced generally semi-circular cross-over conductors, said conductors defining a workpiece heating chamber with an open side;
b. providing a turret having a series of workpiece supporting stations with axially spaced support elements and indexable to move stations in an arcuate path intersecting said heating chamber;
c. loading a first workpiece between said support elements on the first of said stations;
d. indexing said turret in a first direction to bring said first workpiece into said heating chamber with the central axis of said first workpiece generally parallel to said parallel conductors;
e. energizing said inductor with alternating current while said first workpiece is rotated about its central axis to heat said first workpiece;
f. then indexing said turret in a second direction to withdraw said heated workpiece from said heating chamber and move an unloaded second station past said inductor with said support elements clearing said inductor;
g. loading a second workpiece between said support elements on said second station; and,
h. then unloading said first workpiece from said first station.

17. A device for inductively heating elongated workpieces, each having a central axis and a cylindrical body, said device comprising: a turret rotatable about a turret axis and having two or more separate, circumferentially spaced workpiece supporting stations, each station including means for supporting a workpiece between two axially spaced elements with the central axis of the supported workpiece being generally parallel to said turret axis and generally equidistant from said turret axis and means for rotating said supported workpiece on each of said supporting stations about its central axis; means for selectively indexing said stations into a number of position exceeding the number of workpiece supporting stations whereby said workpieces are shifted along an arcuate path; an elongated induction heating inductor extending parallel to said turret axis and having an elongated heating chamber with an open side; means for fixing said inductor at one of said positions with said chamber on said arcuate path and said open side facing generally tangential to said path; and said index means including means for moving an empty station past said inductor in a first direction along said path and means for moving a loaded station in a second direction opposite to said first direction to said one position with said supported workpiece of said loaded station being in said heating chamber of said inductor.

18. A device as defined in claim 17 wherein said inductor has a given length and said supporting stations each include axially retractable workpiece supporting elements movable toward each other to a distance less than the length of said inductor and means for axially shifting at least one of said elements of said empty station to provide a spacing between said elements greater than said inductor length when said empty station is rotated past said inductor.

19. A device as defined in claim 18 wherein said one element includes a cam follower and said device includes a cam element adjacent said inductor, said cam element having a cam surface means axially spaced from said inductor for engaging said cam follower when said turret means is moved in said first direction, said cam surface means coacting with said follower to shift said one element axially from the other of said elements.

20. A device as defined in claim 17 wherein said open side faces generally longitudinally.

21. A method of heating elongated workpieces each having a central axis and a cylindrical body portion, said method comprising the following steps:

a. providing an inductor having a given length and including an elongated heating chamber with an open side;
b. providing a workpiece supporting station including two workpiece support elements spaced in a direction parallel to said elongated heating chamber a distance greater than said given length;
c. moving said station in a first direction on an arcuate path intersecting said heating chamber and past said inductor with said elements clearing said inductor;
d. loading a workpiece onto said station between said elements;
e. moving said station in a second direction opposite to said first direction on said path to a position with said workpiece passing through said open side and into said heating chamber;
f. rotating said workpiece on said station;
g. energizing said inductor with an alternating current; and,
h. moving said station in said first direction along said path and from said heating chamber.

22. The method as defined in claim 21 including the additional steps of:

i. unloading said workpiece from said station;
j. again moving said station along said path in said first direction past said inductor.

23. The method defined in claim 21 including the additional step of:

i. physically straightening said workpiece in said station after said workpiece has been heated and said station has been moved in said first direction.

24. A method as defined in claim 21 including the additional step of:

i. quenching said workpiece in a liquid bath while said workpiece is supported on said station and after said workpiece has been heated and said station has been moved in said first direction.

25. A device for inductively heating elongated workpieces having a central axis, a given length, and a cylindrical body, said device comprising: a fixed elongated inductor having a length corresponding to said given length and an elongated heating chamber with an open side facing in a first direction; a workpiece carrier including two spaced workpiece supporting elements for supporting a workpiece therebetween for rotation about a rotational axis defined by said elements and corresponding to said central axis; means for moving said carrier in two directions along a path defined by said rotational axis and intersecting said induction heating chamber, one of said two directions corresponding to said first direction; and means for axially retracting at least one of said supporting elements from the other of said elements a distance creating a spacing between said elements greater than the length of said inductor when said carrier is moved in said direction past said inductor.

26. A device for inductively heating an elongated workpiece having a central axis and a given length, said device comprising a fixed elongated inductor having a length corresponding to said given length and an elongated heating chamber with an open side facing in a first direction; a workpiece carrier movable in two directions along a path extending through said chamber including two spaced workpiece supporting elements for supporting a workpiece therebetween for rotation about a rotational axis defined by said elements and corresponding to said central axis; means for retracting each of said elements in a direction from the other element; means on one side of said inductor for operating said retracting means to retract said element; means extending along said path from said one side to the other side of said inductor for holding said elements retracted when said carrier is moved in said first direction; said holding means allowing said elements to be extended toward each other with a spacing less than said inductor length when said carrier is moved in a second direction opposite to said first direction.

* * * * *